United States Patent [19]

Scholl et al.

[11] 4,160,423

[45] Jul. 10, 1979

[54] DEVICE FOR MAKING SLIT FACINGS OF A GARMENT

[75] Inventors: Hans Scholl, Oberlinghausen-Lipperreihe; Helmut Tiemann, Bielefeld, both of Fed. Rep. of Germany

[73] Assignee: Kochs Adler AG, Bielefeld, Fed. Rep. of Germany

[21] Appl. No.: 934,543

[22] Filed: Aug. 17, 1978

[51] Int. Cl.[2] ..... D05B 21/00

[52] U.S. Cl. ..... 112/121.12; 223/38

[58] Field of Search ..... 112/121.12, 121.15, 112/121.11, 121.27, 47; 223/38

[56] References Cited

U.S. PATENT DOCUMENTS

| | | | |
|---|---|---|---|
| 2,453,623 | 11/1948 | Gilbert et al. | 223/38 |
| 3,491,926 | 1/1970 | Tucci | 223/38 |
| 3,517,630 | 6/1970 | Bennison et al. | 112/121.12 |
| 3,664,283 | 5/1972 | McFalls | 112/121.15 |
| 3,777,684 | 12/1973 | Friedman et al. | 112/121.27 X |
| 4,037,386 | 7/1977 | Sjoman | 223/38 X |

*Primary Examiner*—H. Hampton Hunter

*Attorney, Agent, or Firm*—Max Fogiel

[57] ABSTRACT

A device for infolding margins of a binding strip, folding the strip about a longitudinally directed main fold line, sewing the folded binding strip to one edge of a slit of a shirt sleeve or a tubular garment, e.g., skirts, blouses, fronts of pullover shirts, and securing the area where the two edges of the slit meet, by means of a seam. The device carries out the working steps in only one uninterrupted sequence of operation. The device can be provided with additional means for preparing a second binding strip and a second sleeve while sewing the two preceding workpiece parts.

11 Claims, 28 Drawing Figures

Fig. 8
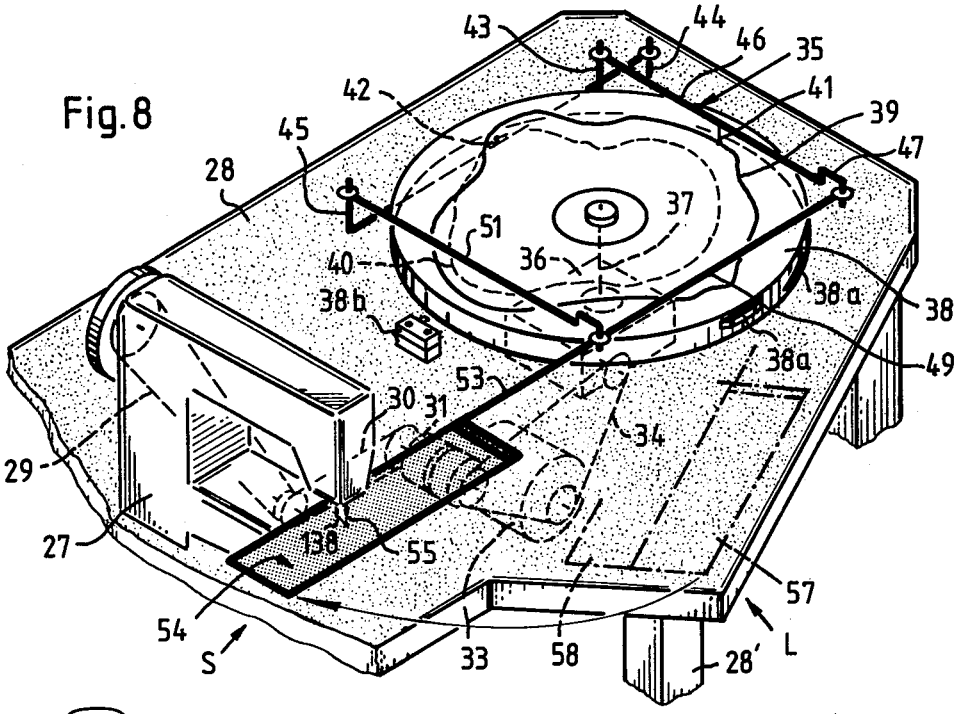
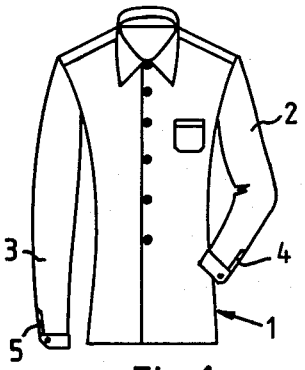
Fig. 1
Fig. 2
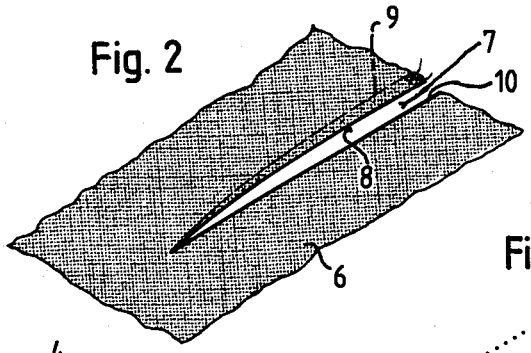
Fig. 6
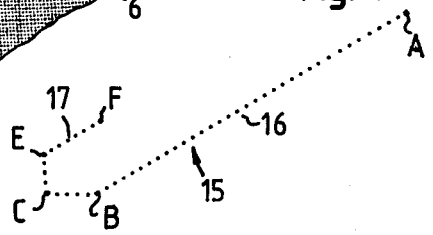
Fig. 3
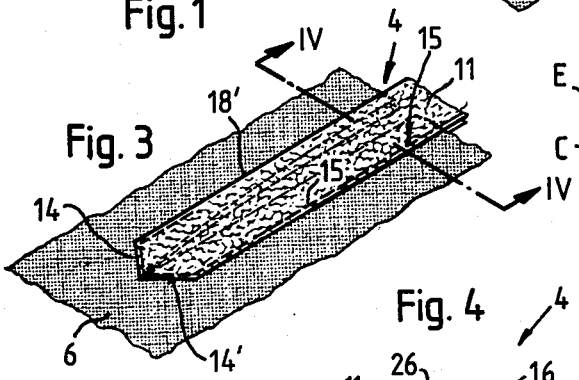
Fig. 4
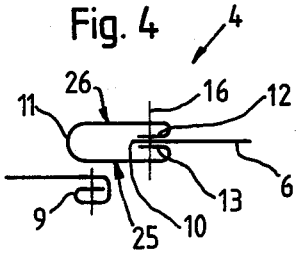
Fig. 7
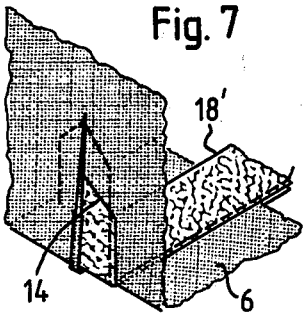

Fig. 5a
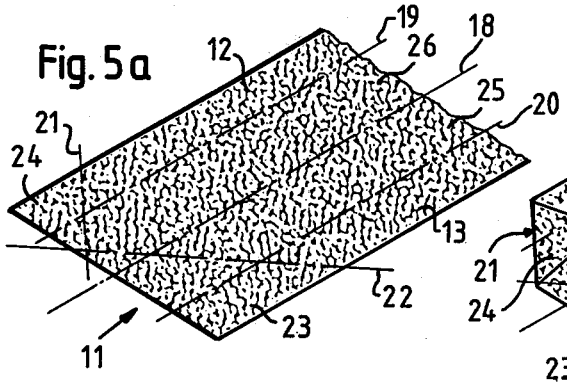
Fig. 5b
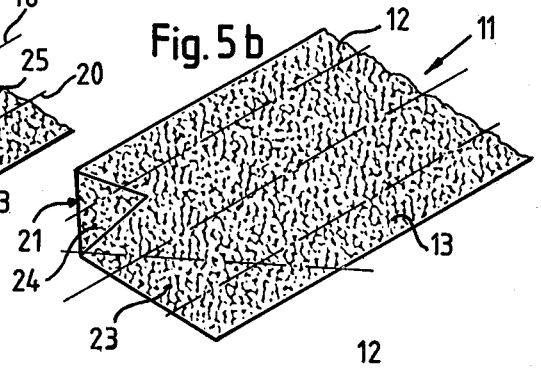
Fig. 5c
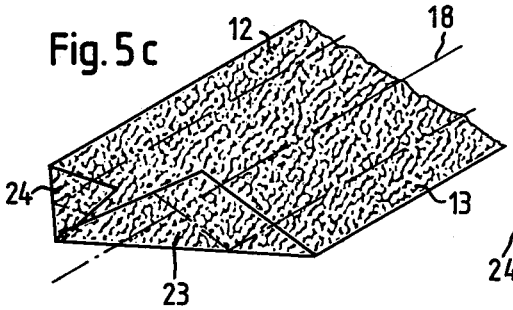
Fig. 5d
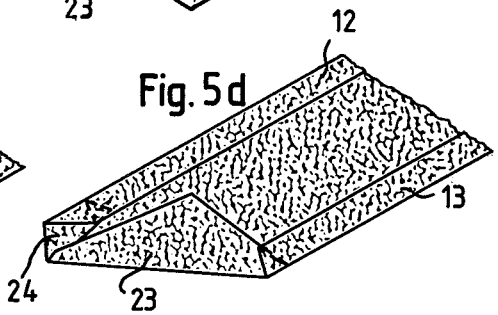
Fig. 5e
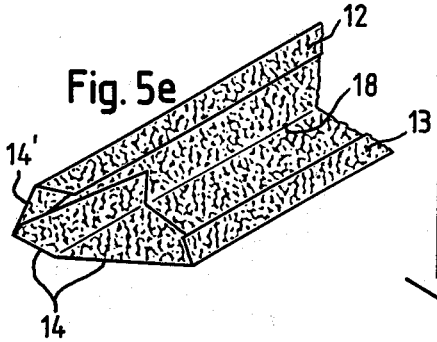
Fig. 10
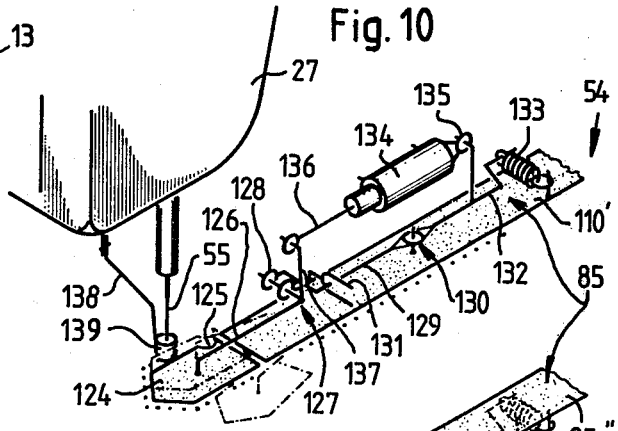
Fig. 5 f
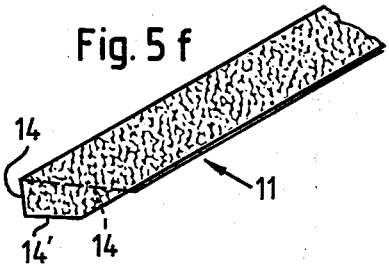
Fig. 10a
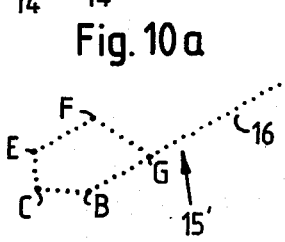
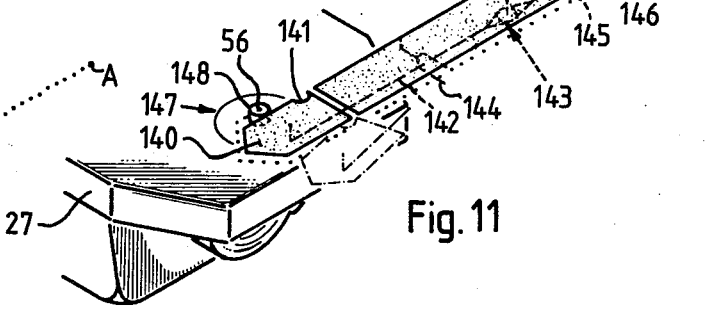
Fig. 11

DEVICE FOR MAKING SLIT FACINGS OF A GARMENT

BACKGROUND OF THE INVENTION

The present invention generally relates to a device for making slit facings of a garment, in particular, for making sleeve plackets having a binding strip folded about one edge of a slit, and securing the slit end against tearing. This kind of placket construction has been applied to shirts and other garments such as blouses of higher quality.

There are various methods known for making such sleeve plackets. A strictly manual procedure can be described as follows: At first, the binding strip is attached at its margin to one edge of a slit of a sleeve blank. After turning the binding strip over the edge and infolding the other margin, the top stitching is performed in a second step while the operator infolds manually the part of the binding strip which secures the slit end. As obvious, the operation of top stitching is quite difficult and time consuming and requires a highly skilled operator to achieve constantly well appearing results.

Consequently, many efforts have been made to simplify the procedure for making the aforesaid sleeve placket, in order to achieve uniform quality by eliminating operator's influence at reduced cost. In the U.S. Pat. No. 2,453,623 there is described the method and an automatic infolding machine for cloth and similar blanks, and also how to prefold a binding strip in a preliminary working step. The folding procedure is performed by applying auxiliary means such as electric heat and moistening for achieving durably pressed prefolded binding strips. The sleeve placket is manufactured in a second working step by top stitching the prefolded binding strip to the sleeve blank by means of a separate sewing machine.

Both aforesaid methods preceed in two different working steps. Since the second one requires additional expensive equipment as well as expenses for stacking and handling the parts to be assembled, the first method depends on high skilled and well paid operators.

SUMMARY OF THE INVENTION

It is the main object of the present invention to create a device for infolding margins of a binding strip, folding the strip about a longitudinally directed fold line and sewing the folded strip to one edge of a slit of a garment and securing the slit and the area where the two edges of the slit meet, in only one operation.

It is a further object of this invention to provide the device with means for producing sleeve plackets of the aforesaid design of high quality.

Another important object of this invention is to reduce the cost of making sleeve plackets according to the described design.

Still another object of this invention is to provide a device for increasing production while reducing the skill required for operating the device.

A further object of the present invention is the provision of a device for processing of two sleeve plackets in an overlapping operating method, e.g., to provide a left and a right sleeve of a garment with plackets of the aforesaid design.

Other objects and advantages of the invention will become apparent from the following description and the novel features will be particularly pointed out in the claims.

BRIEF DESCRIPTION OF THE DRAWINGS

The invention is illustrated in the accompanying drawings in which;

FIG. 1 is a front view of a shirt with long sleeves having slit facings;

FIG. 2 is a perspective view of a sleeve blank, partly broken away;

FIG. 3 shows the sleeve blank of FIG. 2 provided with a binding strip, partly broken away and in a perspective view;

FIG. 4 is a schematic section taken along line IV—IV of FIG. 3 showing a hemmed edge and a binding strip faced edge of a sleeve slit;

FIGS. 5*a* to 5*f* demonstrate a binding strip blank in different and perspective views showing the folding of the strip in a sequence necessary for forming the folded binding strip;

FIG. 6 is a perspective schematic view of a stitching row;

FIG. 7 shows the sleeve blank provided with a binding strip corresponding to FIG. 3, however with an angularly folded portion in a rear view;

FIG. 8 is a perspective schematic top view of the device including a sewing machine, a workpiece receiving and folding device and the moving means;

FIG. 10 shows the left half of a modified binding strip receiving plate in operative position and the press pad of the sewing machine, in a schematic and perspective view, but without the other parts of the workpiece receiving and folding device;

FIG. 10*a* is a perspective schematic view of a stitching row which is closed upon itself;

FIG. 11 is a schematic and perspective view of the right half of the modified binding strip receiving plate in operative position and the throat plate of the sewing machine, but without the other parts of the workpiece receiving and folding device;

DESCRIPTION OF THE INVENTION

Figure 9:
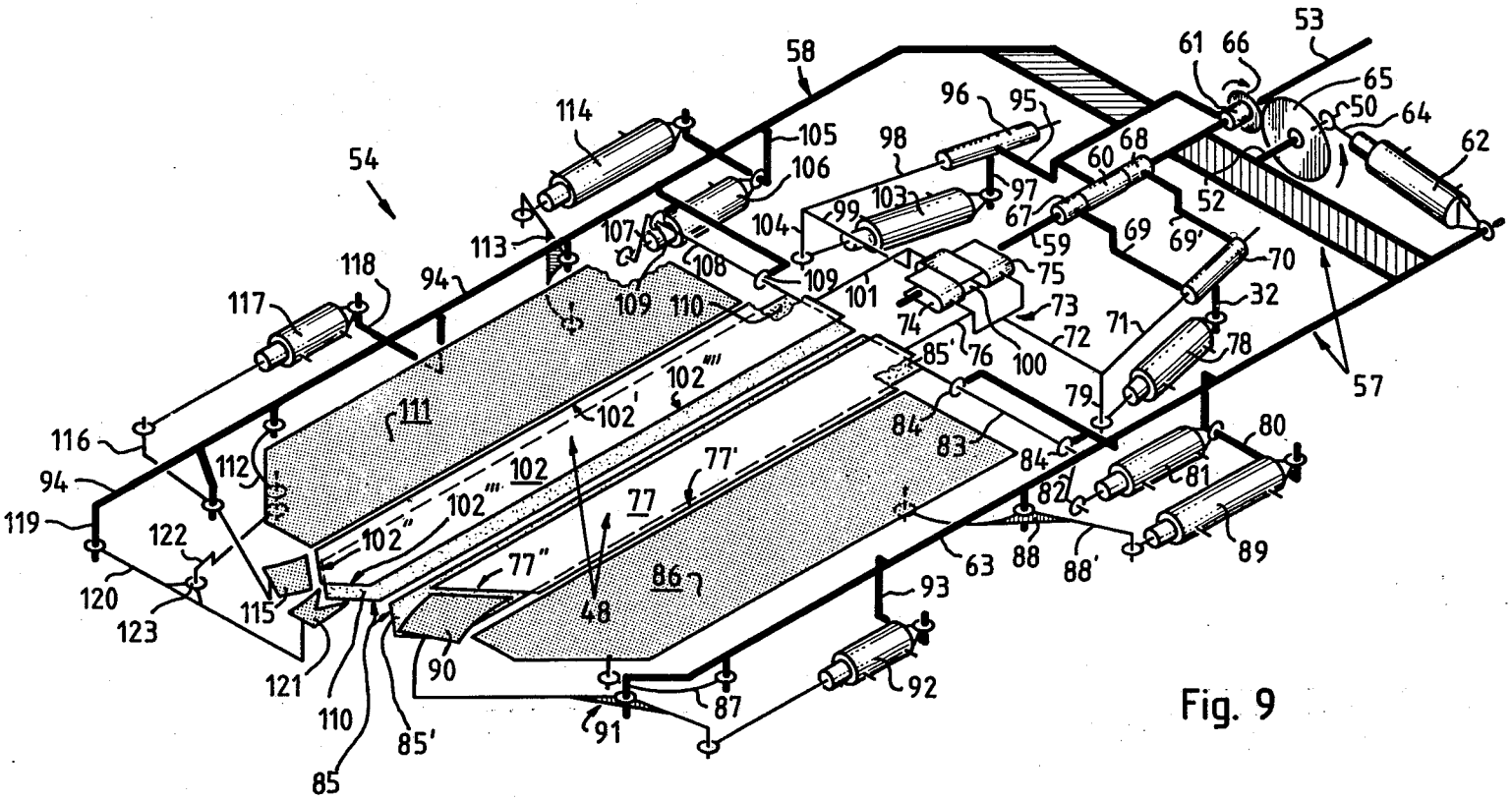
FIG. 9 is an enlarged perspective schematic view of the workpiece receiving and folding device with the left and right halves of the binding strip receiving plate for supporting the strip blank, the defining blade halves, the infolding blades and the turning and retracting means.

Referring to the drawings, FIG. 1 shows a shirt 1 having a right sleeve 2 and a left sleeve 3, looking perpendicularly at the drawing, each of which is provided with a right slit facing 4 resp. a left slit facing 5. For simplifying further considerations and explanations of making a sleeve slit facing, only the right slit facing 4 will be illustrated and named with "slit facing 4" from now on.

In order to manufacture this slit facing 4, a sleeve blank 6 (FIG. 2) is provided with a slit 7, one edge 8 of which has a double folded seam 9 (FIGS. 2, 4). Only the other edge 10 is to be formed into a slit facing 4, which consists of a binding strip 11 having infolded left 12 and right margins 13, two angularly infolded portions 14, 14' (FIGS. 3 and 7) and a longitudinally directed main fold edge 18'. The stitch row 15 for securing the folded binding strip 11 to the edge 10 of the slit 7 comprises a straight part 16 (FIG. 6) as shown from A to B, a short straight part 17 as shown from E to F, and a V-formed part B-C-E corresponding to the angularly infolded portions 14, 14'in FIG. 3. The folding method for the binding strip 11 proceeds in a sequence as shown in FIGS. 5*a* to 5*f*. For a convenient explanation, the illustration of the unfolded binding strip 11 (FIG. 5*a*) further contains a main fold line 18 corresponding to the longitudinally directed main fold edge 18' in FIGS. 3, 4 and 7 and dividing the binding strip 11 into a left binding strip half 26 and a right binding strip half 25, a left fold 19, a right fold line 20, a short diagonal fold line 21 and a long diagonal be folded line 22, about which the binding strip 11 is to fold. The above named fold lines further divide the binding strip 11 into a small triangle margin 24, a large triangle margin 23 and the left margin 12 and the right margin 13.

As illustrated in the perspective schematic top view of FIG. 8, the device includes a stand 28' with a base plate 28, a sewing machine 27 situated on the base plate 28, a control disc 38, an electric motor 33, a clutch coupling 31, a gearing 36 provided with a vertical shaft 37 which carries the control disc 38 and a clutch (not shown), driving belts 29, 30 between the clutch coupling 31 and the sewing machine 27, a driving belt 34 between the electric motor 33 and the clutch coupling 31 and the gearing 36, a linkage 35 and a workpiece receiving and folding unit 54.

The control disc 38 has an upper cam groove 39 which cooperates with an upper cam follower 41, and a lower cam groove 40 cooperating with a lower cam follower 42. The linkage 35 consists of a lower level 45 which carries the lower cam follower 42 and is hinged to a stud 44 secured to the base plate 28, an upper level 46 which is provided with the upper cam follower 41 and is hinged to a second stud 43 likewise secured to the base plate 28, a second upper lever 49 linked to the free end 47 of the upper lever 46 and provided with a leg portion 53 which carries the workpiece receiving and folding unit 54, and a link bar 51 linked to the free end of the lower lever 45 and to the second upper lever 49.

Referring now more particularly to the schematically drawn FIG. 9, the workpiece receiving and folding unit 54 essentially comprises a stationary part 57 and a movable part 58 with a swingable left frame 94 which is provided with bearings 60 and 61 pivoted on an axis 59 fastened to a right frame 63 of the stationary part 57. In order to swing the movable part 58 about the axis 59 through 180 degrees, the bearing 61 carries a driven gear 66 which meshes with a driving gear 65 pivoted to a shaft 52 which is secured to the stationary part 57. The driving gear 65 has a larger pitch diameter than that of the driven gear 66 and a crank pin 50 for cooperation with a piston rod 64 of a first cylinder 62 pivoted to the frame 63 of the stationary part 57.

Two collars 67, 68 are received on the axis 59 and secured against movements. The collar 67 is provided with a longer arm 69, while the collar 68 shows a shorter arm 69' in order to determinate an angular position of a guide bushing 70 which is connected to the free ends of the arms 69, 69', in relation to the axis 59. In the guide bushing 70 is slideably received a guide bar 71 which is formed with a rod 72 extending rectangularly to the axis 59, a vertical stud 79 and a forked part 73 at the end of the rod 72. The forked part 73 carries two U-shaped bearings 74, 75 slideably embracing the axis 59, and a connecting bar 76 to which is secured a right blade half 77 of a defining blade 48. A second cylinder 78 is pivoted on a stud 32 which is secured to the guide bushing 70, for acting upon the vertical stud 79.

The frame 63 of the stationary part 57 is further provided with a jib 80 for pivotally receiving a third cylinder 81 and a fourth cylinder 89. The third cylinder 81 is connected with a crank 82 which is a part of a shaft 83 received in bearings 84 of the frame 63 and carries a right half 85' of a binding strip receiving plate 85, as shown in a cut-away-portion of the right blade half 77 of the defining blade 48. The fourth cylinder 89 is linked to one arm 88' of a double armed lever 88 which is also pivoted to the frame 63. The free arm of the two-armed lever 88 is linked to a right infolding blade 86. A guide rod 87 linked between the right frame 63 and the front part of the right infolding blade 86, serves for its parallelly directed movement in relation to the longitudinal edge 77' of the right blade half 77.

For the cooperation with an edge 77" angularly extending with respect to the longitudinally extending edge 77' of the right defining blade half 77, there is provided a right tip infolding blade 90 which is secured to a double-armed lever 91 pivoted to the right frame 63 and linked with its free arm to the piston of a fifth cylinder 92 which is linked to a jib 93 of the right frame 63.

The swingable left frame 94 of the movable part 58 belonging to the workpiece receiving and folding unit 54 and connected with the bearings 60 and 61, has an arm 95 carrying a guide bushing 96 which is provided with a stud 97. The guide bushing 96 symmetrically located to the guide bushing 70, receives a guide bar 98 connected with a rod 99 which is provided with a U-shaped bearing 100 slideably embracing the axis 59 between the two U-shaped bearings 74, 75. The rod 99 is furthermore provided with a connecting bar 101 which carries a left blade half 102 of the defining blade 48. A sixth cylinder 103 is linked between the stud 97 and a vertical plug 104 secured to the guide bar 98. The frame 94 has a jib 105 to which are linked a seventh cylinder 106 and an eighth cylinder 114. The cylinder 106 acts upon a crank 107 which is a part of a shaft 108 received in bearings 109 of the swingable left frame 94. The shaft 108 carries a left half 110 of the binding strip receiving plate 85.

For cooperating with an edge 102', of the left blade half 102 a left infolding blade 111, which is linked to a two-armed lever 113, and a guide rod 112 are used. The free ends of the guide rod 112 and the two-armed lever 113 are pivoted to the swingable left frame 94, the free end of which is connected with the piston of the eighth cylinder 114.

The left blade half 102 is provided with two edges 102'' and 102''' angularly extending with respect to the two longitudinally extending edges 102'''' and 102' of the left defining blade left 102, for forming the angularly infolded portions 14, 14' (FIG. 3) in cooperation with a left tip infolding blade 115 and an auxiliary infolding blade 121. The left tip infolding blade 115 is fastened to one arm of a double-armed lever 116 which is pivoted to the left frame 94. The free arm of the lever 116 is connected with a piston rod of a ninth cylinder 117 hinged to a bearing 118 of the left frame 94.

Pivoted to a further bearing 119 is a lever 120 which is provided with the auxiliary infolding blade 121 for cooperating with the edge 102''' of the blade half 102.

The lever 120 is connected with the left infolding blade 111 by means of a connecting rod 122 which is linked to a joint 123 of the lever 120 and to the infolding blade 111 in the turning point of the guide rod 112.

For controlling the cylinders 62, 78, 81, 89, 92, 103, 106, 114, 117, the clutch coupling 31 and the coupling of the gearing 36, the control disk 38 is provided with cams 38*a* (only one is shown in the drawings) which cooperate with switches 38*b* and with a control system (not shown).

The device for infolding the margins of a binding strip, folding the strip about a longitudinally directed main fold line and sewing the folded binding strip to one edge of a shirt sleeve or tubular garment with a seam as shown in FIG. 6, can be described as follows:

It may be assumed that, as shown in FIGS. 8 and 9, the workpiece receiving and folding unit 54 is in the loading position L. In this position L the sewing machine 27 and the control disk 38 are uncoupled from the running electric motor 33. Now, the operator can manually load a binding strip 11 in form of a rectangular blank into the workpiece receiving and folding unit 54 upon the left half 110 and the right half 85' of the binding strip receiving plate 85 and the right tip infolding blade 90, and between the right and left blade halves 77, 102 of the defining blade 48 (FIG. 15*a*).

After aligning of the binding strip 11, the left margin 12 lies on the left infolding blade 111 and the right margin 13 on the right infolding blade 86. Furthermore, portions of the left tip infolding blade 115 and the auxiliary infolding blade 121 are covered by the unfolded binding strip 11.

After switching on the clutch of the gearing 36, the control disk 38 will be connected with the running motor 33 which causes its turning until the cam 38*a* has actuated the switch 38*b* (FIG. 8), which causes the disengagement of the gearing coupling and the standstill of the control disk 38 and the starting of a not shown remote control for the admission of air to the cylinders, which are situated in the workpiece receiving and folding unit 54 (FIG. 9).

Figure 15A:
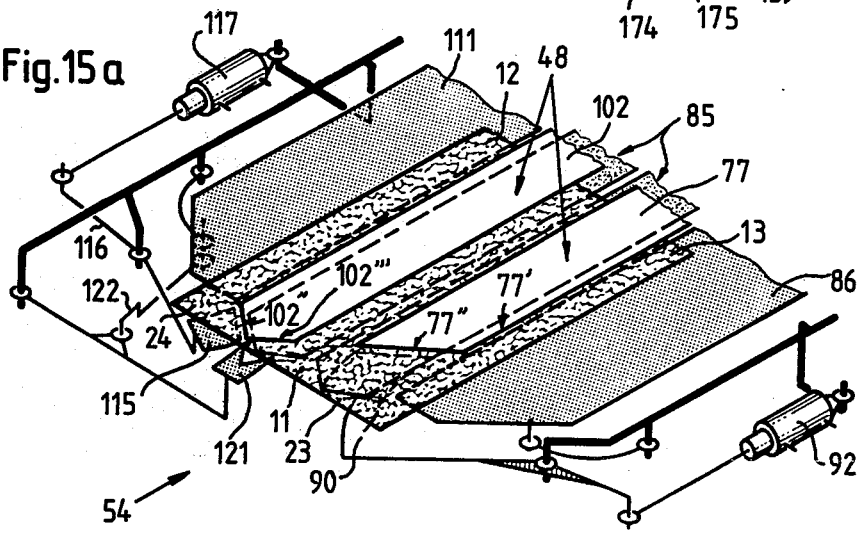
FIG. 15*a* is a partial view of FIG. 9 and shows a binding strip blank which is deposited upon the binding strip receiving plate.

By admitting of the ninth cylinder 117, the left infolding blade 115 will be actuated by means of the double-armed lever 116, for folding the small triangle margin 24 (FIGS. 5*b*, 15*a*) about the edge 102'' of the left blade half 102 of the defining blade 48; after that, the fifth cylinder 92 actuates the right tip infolding blade 90 for folding the large triangle margin 23 (FIG. 5*c*) about the edge 77'' of the right blade half 77 of the defining blade 48 (FIG. 15*a*).

Hereupon, the left margin 12 is folded about the edge 102'' of the left blade half 102 by means of the left infolding blade 111 and by actuating the eighth cylinder 114, and the right margin 13 about the edge 77' of the right blade half 77 by means of the right infolding blade 86 and the fourth cylinder 89 (FIGS. 9, 15*a*). During the swivel movement of the left and right infolding blades 86, 111 parallel to the longitudinally extending edges 77' respectively 102' of the defining blade 48, at which the infolding blades 86, 111 perform a compound movement toward the defining blade 48 and toward the hinged connection (axis 59) of the frames 63, 94, the auxiliary infolding blade 121 will be taken along by means of the connecting rod 122, in order to act upon the infolded large triangle margin 23 (FIGS. 5*d*, 15*a*) for preventing accumulations of material in the folded edges.

In order to obtain a proper infolding of the binding strip edges, it will be noted that the bottom surfaces of the infolding blades 86, 111, 90, 115 and 121 lie in one plane with the upper sides of the defining blades 77 and 102.

Figure 15B:
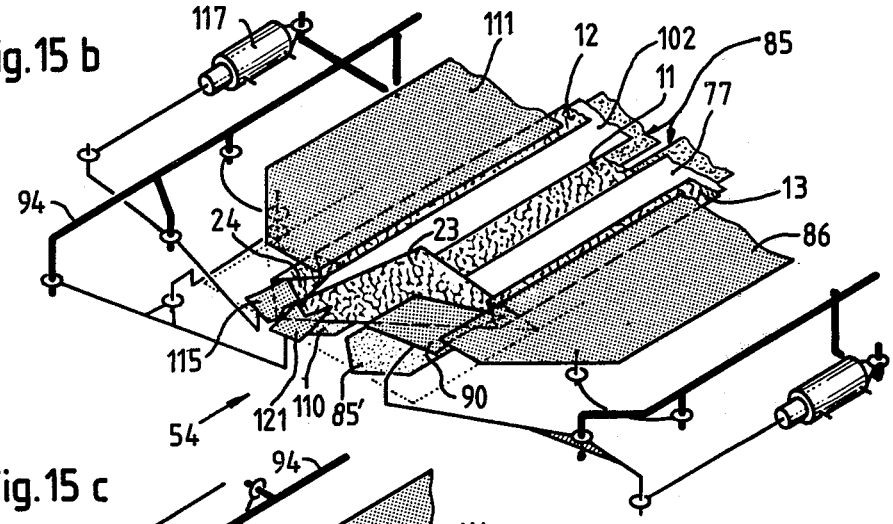
FIG. 15*b* shows the folding of the margins of the binding strip blank about the edges of the defining blade halves.

FIG. 15*b* shows a part of the workpiece receiving and folding unit 54 with the binding strip 11, the margins 12, 13, 23 and 24 of which infolded and clamped by means of the infolding blades 86, 90, 111, 115 and 121.

Figure 15C:
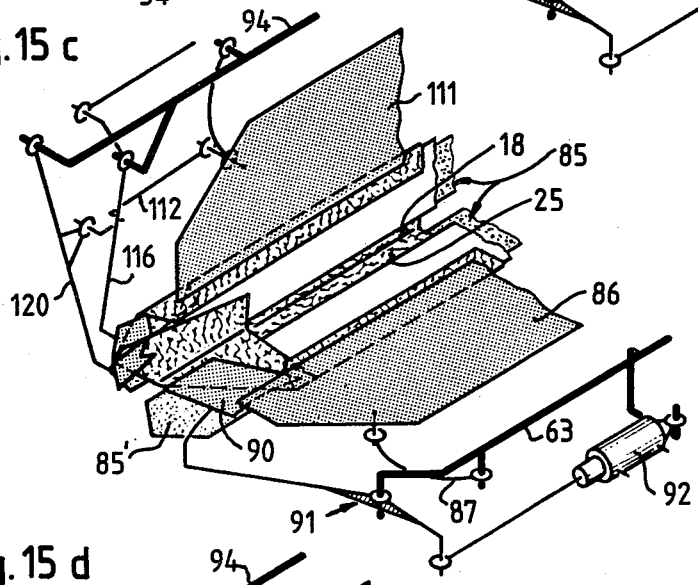
FIG. 15*c* and FIG. 15*d* show the left half of the infolded and clamped binding strip blank turned-up by approx. 90° and the inserting of the slitted shirt sleeve.
Figure 15D:
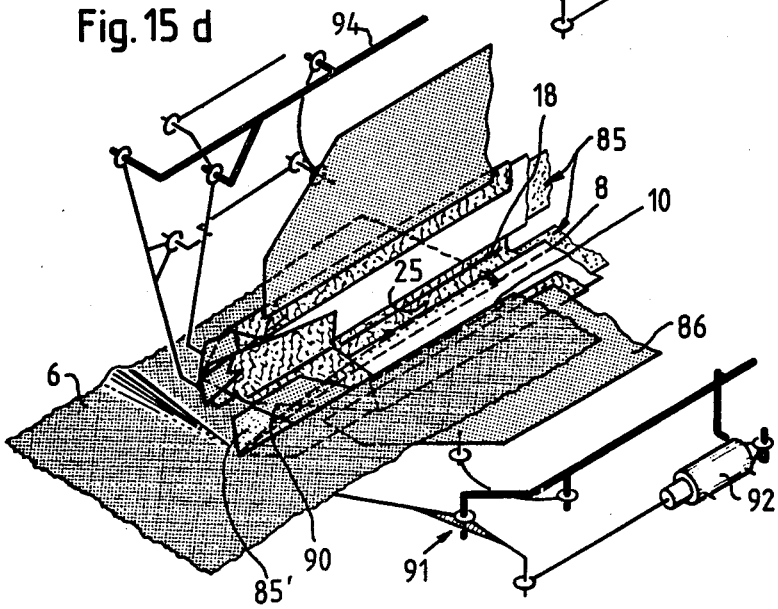

With regard to the FIGS. 9 and 15*c*, it is evident, that after admitting of the cylinder 62 the driving gear 65 and the driven gear 66 are driven in the directions of the drawn arrows (FIG. 9), and the swingable left frame 94 of the movable part 58 will be swung about the axis 59 into an upright position as shown in FIG. 15*c*, in order to prefold the binding strip 11 about the main fold line 18. In this position, the right half 85' of the binding strip receiving plate 85 is lowered by an action of the third cylinder 81, in order to make room for the sleeve blank 6 with its edge 8 underneath the right binding strip half 25 (FIGS. 15*d* and 4). Then, the other edge 10 of the sleeve blank 6 lies on the right infolding blank 86 and partly on the right tip infolding blade 90 and the right half 85' of the binding strip receiving plate 85. After the procedure of aligning the sleeve blank 6 to the prefolded binding strip 11, the operator triggers the interrupted remote control, in order to complete the folding action. Consequently, the right half 85' of the binding strip receiving plate 85 has been lifted by the third cylinder 81 (FIG. 9) and the left frame 94 of the moveable part 58 has terminated the swing motion by 180° about the axis 59 and the main fold line 18 of the binding strip 11, thus covering the edge 10 of the sleeve blank 6 (FIGS. 15*d*, 15*e*).

Figure 15E:
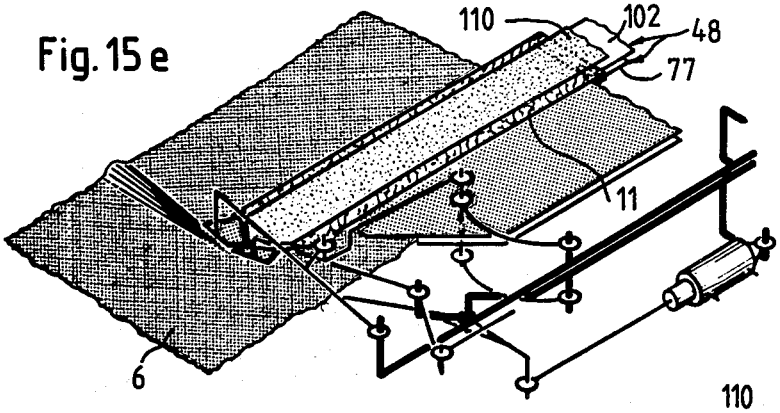
FIG. 15*e* shows the left half of the infolded and clamped binding strip blank turned by 180°.

As shown in FIGS. 9 and 15*e*, the left half 110 of the binding strip receiving plate 85, now lying on top, acts like a workpiece clamping plate for holding together the infolded binding strip 11 and the sleeve blank 6, while the left blade half 102 of the defining blade 48 lies above the right blade half 77.

Figure 15F:
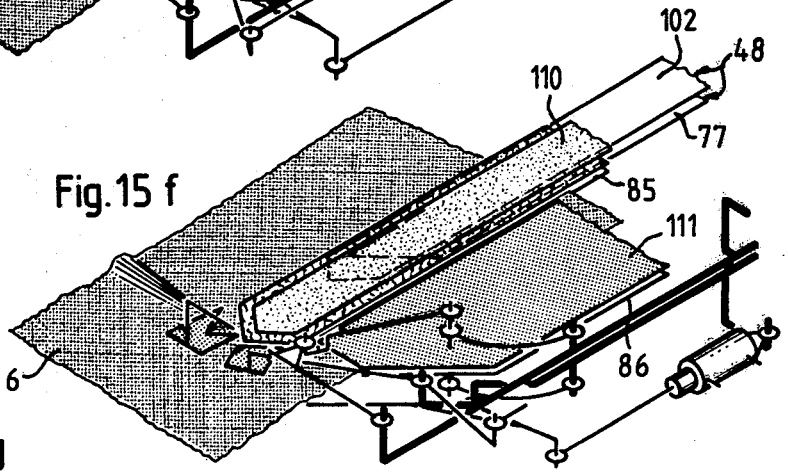
FIG. 15*f* is a view corresponding to FIG. 15*e*, however with retracted defining blades.
Figure 15G:
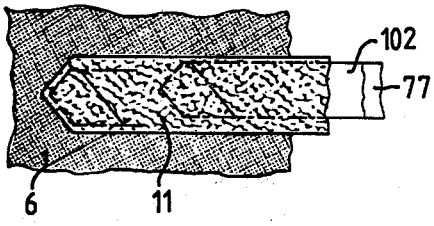
FIG. 15*g* is a partial top plane view corresponding to FIG. 15*f*, however with a removed binding strip receiving plate.

The next steps prior to stitching may be described with reference to FIGS. 15*f*, 15*g* and in connection with FIG. 9 as follows:

Both the second cylinder 78 and the sixth cylinder 103 will be simultaneously actuated by air, whereupon, effected by the angularly situated guide bushings 70 and 96, the right blade half 77 and the left blade half 102 of the defining blade 48 will also be retracted in an angularly directed path, in order to procure a field for forming a stitch row. Thereupon, the right and the left infolding blades 86, 111 will be retracted by means of the cylinders 89 and 114, while the right and left tip infolding blades 90, 115 are retracted by means of the cylinders 92, 117 and the auxiliary infolding blade 121 by means of the left infolding blade 111 during its retraction.

After that, the control disk 38 will be coupled to the electric motor 33 loaded workpiece receiving and folding unit 54 will be transferred out of the loading position L into the sewing position S (FIG. 8) and that under the needle 55 and the press pad 138 of the sewing machine 27, which will be coupled to the running electric motor 33 by means of the clutch coupling 31, in order to form stitches during the guidance of the unit 54 corresponding to the courses of the cam grooves 39, 40. After termination of the stitch row 15 as shown in FIG. 6, the seam will be locked at the end F of the short straight part 17 in a known manner, and the threads will be cut off after terminating the sewing cycle and uncoupling of the sewing machine 27 from the motor 33.

Now, the workpiece receiving and folding unit 54 will be brought back into the loading position L (FIG. 8). At this point, the left half 110 of the binding strip receiving plate 85 is lifted about its shaft 108 by the reversed action of the cylinder 106, in order to unclamp the finished sewn workpiece for removing it from the right and left blade halves 77, 102, which are partly located within the binding strip 11. Thereupon, the moveable part 58 of the workpiece receiving and folding unit 54 will be swung into its initial position in addition to the folding means as shown in FIG. 9.

For attaching an unfolded binding strip to an edge of a slit of a shirt sleeve by means of a seam which has a stitching row 15' (FIG. 10*a*) closed upon itself within the area where the two edges 8, 10 (FIG. 2) of the slit meet, the left half 110' and the right half 85'' (FIGS. 10, 11) of the binding strip receiving plate 85 are modified and provided with a left end piece 124 for the left half 110' and a right end piece 140 for the right half 85''.

The left end piece 124 (FIG. 10), which is formed with a cut-out 125, is fastened to one arm 126 of an angle lever 127. This lever 127 is pivotally received in a bearing 128 which is arranged at one end 129 of a double-armed lever 130 hinged at the left half 110' and guided in a lateral guide 131 at its one end 129. The guidance 131 is fastened to the left half 110'. The other end 132 of the double-armed lever 130 is connected with a tension spring 133, the free end of which is fastened to the left half 110' of the binding strip receiving blade 85. A tenth cylinder 134 is hinged at a bearing 135 for acting with its piston rod 136 upon the free arm 137 of the angle lever 127. The sewing machine 27 (FIG. 10) is provided with a press pad 138 which is formed with a tubular part 139 for the passage of the needle 55.

Referring now to FIG. 11, the right end piece 140 is also provided with a cut-out 141 and carried by one arm 142 of a double-armed lever 143, which is hinged at the underside of the right half 85'' of the binding strip receiving plate 85 and laterally guided in a guidance 144. The free arm 145 of the double-armed lever 143 is connected with one end of a tension spring 146, the other end of which is fastened to the right half 85''. The throat plate 147 of the sewing machine 27 is provided with a cylindrical stud 148 having a stitch hole 56.

In connection with FIGS. 15*f*, 15*g*, the function of the left and right end pieces 124 and 140 can be described as follows: In order to stitch the straight part F to G square with the straight part 16 of the stitch row 15', shown in FIG. 10*a*, it is necessary to keep clear the area G-B-C-E-F not only from the defining blades 77, 102 (FIG. 15*g*) but also partly from the halves 85,110 (FIG. 15*f*) of the binding strip receiving plate 85. For this purpose, as shown in FIGS. 10 and 11, the left and right halves 110' and 85'' are provided with the aforesaid removable left and right end pieces 124 and 140. When the workpiece receiving and folding unit 54, of which only the binding strip receiving plate 85 is shown in FIGS. 10 and 11, has been moved into the position denoted by F in FIG. 10*a*, the control disk 38 causes the changing of the moving direction of the unit 54. Simultaneously, the tenth cylinder 134 effects a lifting of the left end piece 124 by means of the angle lever 127, in order to eliminate the pressure upon the parts to be stitched. When moving now the unit 54, the cut-outs 125, 141 of the left and right end pieces 124 and 140 engage the tubular part 139 of the press pad 138 and the cylindrical stud 148 of the throat plate 147. By this, the movable end pieces 124 and 140 will be swung out progressively with the forming of the seam from point F to point G (FIG. 10*a*) for finishing the stitch row 15' closed upon itself.

After terminating the seam, the unit 54 will be brought into the loading position L (FIG. 8), at which the left and right end pieces 124 and 140 will be retracted out of the dot-dash line (FIGS. 10, 11) into the initial positions by means of springs 133, 146.

Figure 12:
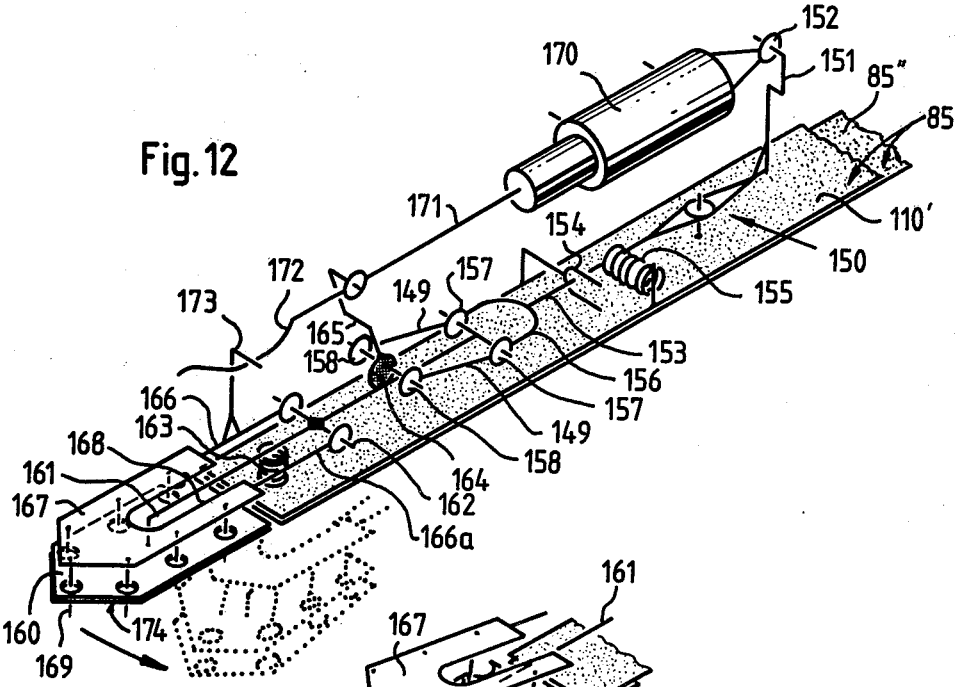
FIG. 12 is a perspective and diagrammatic representation of a left and a right half of a further modified binding strip receiving plate in operative position.
Figure 13:
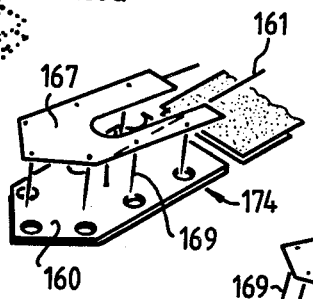
FIG. 13 and FIG. 14 are partial views of FIG. 12 showing the receiving plate halves in different sequential positions.
Figure 14:
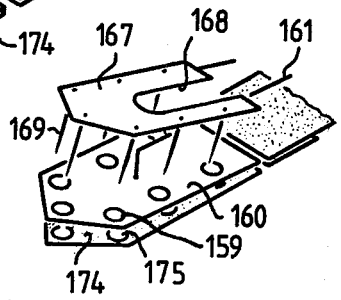

A modified embodiment of the movable left and right end pieces 124 and 140 of FIGS. 10, 11 is shown in FIGS. 12,13 and 14. The left half 110' of the binding strip receiving plate 85 (FIG. 12) has a movable left end piece 160 which is provided with holes 159 and fastened to a lever 161. This lever 161 is pivotally mounted in bearings 157 of a double-armed lever 150, one arm 151 of which has a bearing 152 while the other arm 153 is laterally guided in a guidance 154, which is secured to the left half 110' of the plate 85. At its free end, the arm 153 has a forked part 156 formed with two bearings 157 and two elongated arms 149 with two bearings 158 for pivotally receiving an eccentric hub 164 of a lever 165, the free end of which is pivoted to a piston rod 171 of an eleventh cylinder 170 which is linked to the bearing 152 of the double-armed lever 150. The lever 161 is pressed against the eccentric hub 164 of the lever 165 by means of a spring 163. A second spring 155 is situated between the arm 153 of the double-armed lever 150 and the left half 110' of the binding strip receiving plate 85. Furthermore, the lever 161 is provided with a bolt 162 on which are pivoted two arms 166, 166*a* which carry a plate 167. The plate 167 carries needles 169 and is provided with a clearance opening 168 for the lever 161.

Secured to the arm 166 is a hook 173 which cooperates with a cam shaped extension 172 provided at the piston rod 171. The right half 85'', the right end piece 174 and the parts for shifting the end piece 174 are essentially formed like the parts shown in FIG. 11, however the end piece 174 (FIGS. 12 to 14) is provided with holes 175 for cooperating with the needles 169.

The operation of the modified embodiment of the movable left and right end pieces shown in FIGS. 12 to 14 can be described with reference to FIGS. 10, 10*a* and 11 as follows:

During sewing the stitch row 15' (FIG. 10*a*) between the points G,B,C,E,F, the plate 167 is in a lowered position as shown in FIG. 12, in which the needles 169 penetrate the two end pieces 160 and 174 within the holes 159, 175 and also the infolded and clamped workpiece (not shown).

Before reaching the point F, the eleventh cylinder 170 will be actuated in order to remove the plate 167 and the needles 169 out of the end pieces 160, 174 and the workpiece by means of the cam shaped extension 172 and the hook 173 (FIG. 12). Thereupon, the left end piece 160 will be lifted by means of the eccentric hub 164 of the lever 165 which acts upon the lever 161 carrying the left end piece 160. Now, the end portion of the seam between F and G (FIG. 10*a*) can be stitched, while the end pieces 160, 174 and the plate 167 will be swung out by means of the press pad 138, tubular part 139 and the cylindrical stud 148 into the position drawn in a dotted line in FIG. 12.

Figure 16:
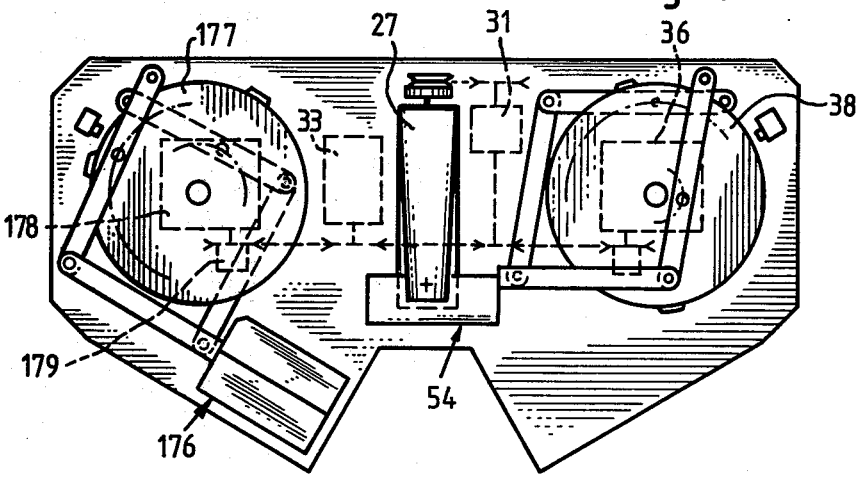
FIG. 16 is a top plan view of a modified device.

A further modified device is shown in FIG. 16, wherein the device as described above is further provided with a second workpiece receiving and folding unit 176 for preparing a second binding strip while the binding strip in the first unit 54 will be sewn by means of the sewing machine 27 and the control disk 38. The second unit 176 will be moved and controlled by a second control disk 177 which is driven by the electric motor 33 and by means of a gearing 178 connected with a clutch coupling 179.

What we claim is:

1. A device for infolding margins of a binding strip, folding said strip about a longitudinally directed main fold line, sewing said folded binding strip to one edge of a slit of a shirt sleeve or a tubular garment and securing the area where the two edges of said slit meet, by means of a stitch row, said device comprising a support, a sewing machine having a reciprocating needle, a throat plate and a workpiece press pad, a workpiece receiving and folding unit, comprising a binding strip receiving plate for supporting said strip with margins projecting therefrom and consisting of a left half and a right half pivotally connected in the longitudinal direction, a defining blade arranged above said binding strip receiving plate and determining the form of said binding strip, and including a left blade half and a right blade half in swivel connection, infolding blades cooperating with said defining blade, for folding said margins of said binding strip about the edges of said defining blade, means for turning one of said halves of said binding strip receiving plate, one of said halves of said defining blade together with one half of said binding strip being clamped to said defining blade by said infolding blades about said longitudinally directed main fold line of said strip into a receiving position for said slitted shirt sleeve, and clamping said folded binding strip between said two halves of said binding strip receiving plate, and means for retracting said infolding blades and releasing said edges to be sewn from said defining blade halves, and means for moving said binding strip clamped to said shirt sleeve relatively to said needle of said sewing machine in order to stitch said infolded edges of said binding strip to said one edge of said slit and producing said stitch row for securing the area where said two edges of said slit meet.

2. A device as claimed in claim 1, further comprising means for forming said stitch row like a stitch row closed upon itself within an area where said two edges of said slit meet.

3. A device as claimed in claim 1, further comprising means for forming said stitch row like a stitch row closed upon itself within an area where said two edges of said slit meet, said means including removable end pieces attached to each of said left and said right half of said binding strip receiving plate, and means for retracting said left defining blade half and said right defining blade half and moving said removable end pieces out of said area where said two edges of said slit meet and out of the path of motion of said needle of said sewing machine when said needle completes the last portion of said stitch row closed upon itself.

4. A device as claimed in claim 1, wherein said left blade half and said right blade half of said defining blade are provided with edges angularly extending with respect to the longitudinally extending edge of said defining blade, and said infolding blades include a left tip infolding blade cooperating with said angularly extending edge of said left blade half and a right tip infolding blade cooperating with said angularly extending edge of said right blade half.

5. A device as claimed in claim 4, wherein said infolding blades further include an auxiliary infolding blade cooperating with said angularly extending edge of said left blade half of said defining blade for preventing accumulations of material in the folded edges.

6. A device as claimed in claim 3, wherein said removable end pieces attached to each of said left half and said right half of said binding strip receiving plate are provided with edges corresponding to the shape of said stitch row for securing said area where said two edges of said slit meet.

7. A device as claimed in claim 3, wherein said sewing machine is provided with a throat plate having a cylindrical stud with a stitchhole for said needle, and a workpiece press pad having a tubular part for the passage of said needle and for pressing said binding strip upon said cylindrical stud of said throat plate during sewing, and said means for moving said removable end pieces out of said area where said two edges of said slit meet, include swivel connecting means between said removable end pieces and said left and said right half of said binding strip receiving plate, and means for resetting said removable end pieces from extended positions caused by said cylindrical stud when abutting against said removable end piece pivotally attached to said right half of said binding strip receiving plate, and by said tubular part of said workpiece press pad when abutting against said removable end piece swingably attached to said left half of said binding strip receiving plate, into the initial positions after completing said last portion of said stitch row closed upon itself.

8. A device as claimed in claim 1, wherein said means for moving said binding strip clamped to said shirt sleeve relatively to said needle of said sewing machine includes a rotatable control disk having cam grooves, a linkage associated with said cam grooves of said control disk and provided with a leg portion carrying said workpiece receiving and folding unit, a driving motor for driving said sewing machine and said control disk and clutch couplings between said driving motor and said control disk and said motor and said sewing machine.

9. A device as claimed in claim 1, further comprising a second workpiece receiving and folding unit for preparing a second binding strip while stitching said binding strip to said one edge of said slit and additional means for moving said second workpiece receiving and folding unit relatively to said needle of said sewing machine after terminating stitching of said binding strip to said slit of said shirt sleeve.

10. A device for infolding margins of a binding strip, folding said strip about a longitudinally directed main fold line, sewing said folded binding strip to one edge of a slit of a shirt sleeve or a tubular garment and securing the area where the two edges of said slit meet, by means of a stitch row closed upon itself, comprising a support, a stationary sewing machine having a reciprocating needle, a throat plate having a cylindrical stud with a stitchhole for said needle and a workpiece press pad having a tubular part for the passage of said needle and for pressing said binding strip upon said cylindrical stud of said throat plate during sewing, a workpiece receiving and folding unit, comprising a binding strip receiving plate for supporting said strip with margins projecting thereof and consisting of a left plate half, a right plate half, end pieces attached to each of said left plate half and said right plate half, and swivel connecting means between said end pieces and said left and said right plate halves, a defining blade arranged above said binding strip receiving plate, including a left blade half and a right blade half, said blade halves being provided with longitudinally and angularly extending edges determining the form of said binding strip, infolding means, comprising a left and a right infolding blade half for folding the longitudinal margins of said binding strip about said longitudinal edges of said left and said right defining blade halves, a left tip infolding blade cooperating with said angularly extending edge of said left blade half, a right tip infolding blade cooperating with said angularly extending edge of said right blade half, an auxiliary infolding blade cooperating with said angularly extending edge of said left blade half of said defining blade for preventing accumulations of material, and control means for operating said infolding means, means for turning one of said halves of said binding strip receiving plate together with one of said end pieces, and one of said halves of said defining blade together with one half of said binding strip being clamped to said defining blade by said infolding blades about said longitudinally directed main fold line of said binding strip, into a receiving position for said slitted shirt sleeve, and clamping said folded binding strip between said two halves of said binding strip receiving plate, means for retracting said left and said right defining blade halves out of said area where said two edges of said slit meet, and out of the path of motion of said needle of said sewing machine, when said needle completes the last portion of said stitch row closed upon itself, and means for retracting said infolding blades, said left tip infolding blade, said right tip infolding blade and said auxiliary infolding plate, means for moving said binding strip clamped to said shirt sleeve along said needle of said sewing machine, in order to stitch said infolded edges of said binding strip to said one edge of said slit, and for producing said stitch row for securing the area where said two edges of said slit meet, and means for resetting said removable end pieces from the extended positions caused by said cylindrical stud when abutting against said removable end piece swingably attached to said right half of said binding strip receiving plate, and by said tubular part of said workpiece press pad when abutting against said removable end piece attached to said left half of said binding strip receiving plate, into the initial positions after completing said last portion of said stitch row closed upon itself.

11. In a device as claimed in claim 10, wherein said end pieces attached to each of said left plate half and said right plate half of said binding strip receiving plate are formed with holes, and said left plate half carries a plate provided with needles and means for lowering said plate, in order to penetrate said holes and said folded binding strip clamped to said sleeve blank by said needles.

* * * * *